US007184685B2

(12) United States Patent
Sato

(10) Patent No.: US 7,184,685 B2
(45) Date of Patent: Feb. 27, 2007

(54) IMAGE FORMING APPARATUS AND PROCESS CARTRIDGE

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 78 days.

(21) Appl. No.: 10/807,424

(22) Filed: Mar. 24, 2004

(65) Prior Publication Data

US 2004/0190935 A1 Sep. 30, 2004

(30) Foreign Application Priority Data

Mar. 31, 2003 (JP) ..... 2003-093419

(51) Int. Cl.
*G03G 21/16* (2006.01)

(52) U.S. Cl. ..... 399/111

(58) Field of Classification Search ..... 399/107, 399/111, 149, 150, 112, 113, 119
See application file for complete search history.

(56) References Cited

U.S. PATENT DOCUMENTS

| | | | | |
|---|---|---|---|---|
| 5,062,003 | A | 10/1991 | Kawabata | |
| 5,604,568 | A | 2/1997 | Iwama | |
| 5,884,117 | A | 3/1999 | Tanoue et al. | |
| 5,970,285 | A * | 10/1999 | Ito et al. | 399/149 |
| 6,041,203 | A | 3/2000 | Suzuki et al. | |
| 6,330,410 | B1 | 12/2001 | Okabe et al. | |
| 6,385,414 | B1 * | 5/2002 | Sato et al. | 399/98 |
| 6,411,789 | B1 | 6/2002 | Okabe et al. | |
| 6,546,217 | B2 | 4/2003 | Okabe et al. | |
| 2003/0118370 | A1 | 6/2003 | Okabe et al. | |

FOREIGN PATENT DOCUMENTS

| | | | |
|---|---|---|---|
| EP | 0 622 696 A | | 11/1994 |
| JP | A-03-118557 | | 5/1991 |
| JP | 04-022976 | * | 1/1992 |
| JP | A 7-301965 | | 11/1995 |
| JP | A 8-286485 | | 11/1996 |
| JP | A 10-20595 | | 1/1998 |
| JP | A-10-228148 | | 8/1998 |
| JP | A 2000-250378 | | 9/2000 |

* cited by examiner

*Primary Examiner*—Hoang Ngo
(74) *Attorney, Agent, or Firm*—Oliff & Berridge, PLC

(57) ABSTRACT

A charger and a developing roller are disposed substantially in a line on both sides of a photosensitive drum in a cross sectional view in a direction perpendicular to an axis of the photosensitive drum, so that no process device is disposed on an upper portion of the photosensitive drum. Thus, a scanner unit can be disposed close to the photosensitive drum. Further, as the photosensitive drum is wide open at its upper portion, a range of a laser beam emitted from the scanner unit is widely provided. Accordingly, parts making up the scanner unit can be arranged with great flexibility, thus the scanner unit can be made thin. Thereby, the laser printer can be made thin.

31 Claims, 2 Drawing Sheets

IMAGE FORMING APPARATUS AND PROCESS CARTRIDGE

BACKGROUND OF THE INVENTION

1. Field of Invention

The invention relates to an image forming apparatus with a charging device, an image holding member, and a developing device arranged substantially in a line, and a process cartridge.

2. Description of Related Art

In conventional image forming apparatuses such as laser printers and copiers, a surface of a photosensitive drum, which is made by laminating a carrier generation layer and a carrier transport layer on a base layer, is charged with a corona discharge by a charger. The photosensitive drum is irradiated with a laser beam emitted from a scanner unit and an electrostatic latent image is formed on the photosensitive drum. The latent image is developed using a developing agent such as toner carried on a developing roller, transferred to a recording medium such as paper by a transfer roller, and heated and transferred entirely to the recording medium by a fixing device. In this way, images are formed on the recording medium.

In the image forming apparatus structured above, to realize the above described image formation process, the charger, the developing roller, and the transfer roller are disposed in this order along a circumference of the photosensitive drum upstream from a direction of rotation of the photosensitive drum. The photosensitive drum is structured to receive a laser beam from the scanner unit between the charger and the developing roller. Thus, there are a lot of parts to be placed around the photosensitive drum. In Japanese Laid-Open Patent Publication No. 2000-250378, the charger is disposed at an upper portion of the photosensitive drum. A portion of the photosensitive drum that is irradiated with a laser beam emitted from the scanner unit is provided immediately downstream from the upper portion of the photosensitive drum, the developing roller is disposed to a side of the photosensitive drum further downstream from the portion, and the transfer roller is disposed at a lower portion of the photosensitive drum. Thus, wasted space around the photosensitive drum is reduced and parts are arranged efficiently.

SUMMARY OF THE INVENTION

However, the image forming apparatus is thick because the charger is disposed above the photosensitive drum at the upper portion of the photosensitive drum. Such placement is detrimental in forming a thin image apparatus. In addition, the range at which the surface of the photosensitive drum is irradiated with a laser beam is limited to a limited range further downstream from the charger. As a result, a laser beam exit position is limited, and a thin profile design of the scanner unit is difficult, thus interfering with a thin profile design of the image forming apparatus.

The invention thus provides, among other things, an image forming apparatus that achieves a thin profile design and a process cartridge for use in the image forming apparatus.

According to one exemplary aspect of the invention, a process cartridge may include a case, an image carrier rotatably provided at the case, a surface of the image carrier being divided into four sections by two perpendicular lines that are perpendicular to a center of the image carrier, a charger that is disposed on the case along the surface of the image carrier and that charges the surface of the image carrier, and a developing member that is disposed on the case along the surface of the image carrier and that supplies a developing agent to the image carrier, wherein the charger is located at a first section of the four sections and the developing member is located at a second section of the four sections that is opposite to the first section.

According to another exemplary aspect of the invention, the image forming apparatus may include an image carrier rotatably provided at the image forming apparatus, a surface of the image carrier being divided into four sections by two perpendicular lines that are perpendicular to a center of the image carrier, a charger that is disposed along the surface of the image carrier and that charges the surface of the image carrier, and a developing member that is disposed along the surface of the image carrier and that supplies a developing agent to the image carrier, wherein the charger is located at a first section of the four sections and the developing member is located at a second section of the four sections that is opposite to the first section.

According to a further exemplary aspect of the invention, a process cartridge may include a photosensitive drum that rotates relative to a photosensitive drum shaft, a charger that is disposed along a surface of the photosensitive drum and that charges the surface of the photosensitive drum, and a developing roller that rotates relative to a developing roller shaft, that is disposed along the surface of the photosensitive drum and that supplies toner to the photosensitive drum, wherein the charger is located along a straight line that connects the photosensitive drum shaft and the developing roller shaft.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of an image forming apparatus and a process cartridge in which the invention is embodied will be described with reference to the accompanying drawings. First, an entire structure of a laser printer 1, which is an example of the image forming apparatus of the embodiment, will be described with reference to FIG. 1.

Figure 1:
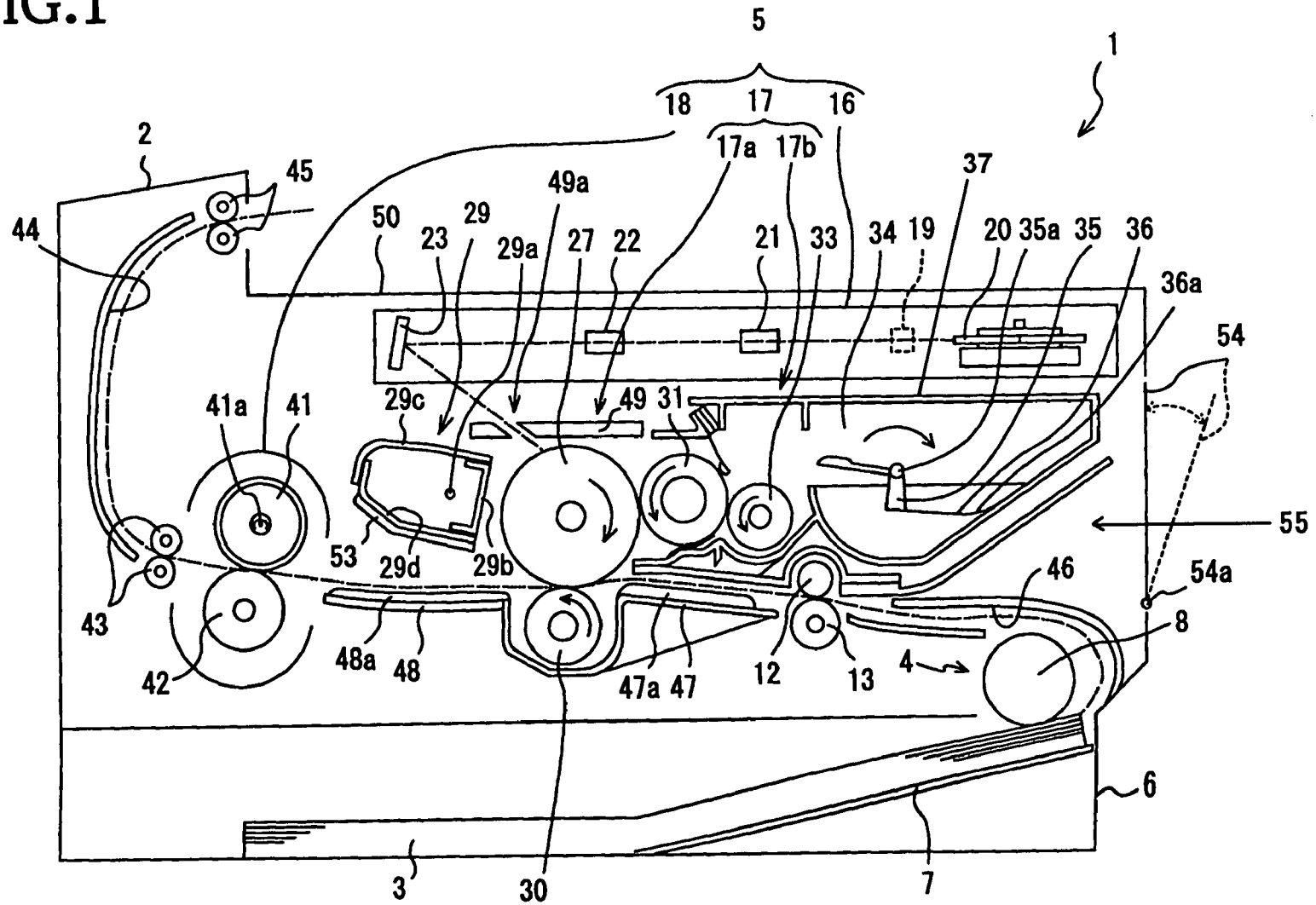
FIG. 1 is a side sectional view of the general structure of a laser printer.

As shown in FIG. 1, the laser printer 1 includes, in a main body 2, a feeder unit 4 for supplying sheets 3, a scanner unit 16, a process cartridge 17, and a fixing unit 18, which constitute an image formation part 5 for printing a supplied sheet 3. In FIG. 1, the right side is a front side of the laser printer 1. A sheet feed path is illustrated with a double dot-dashed line, and a light path of a laser beam is indicated with a dot-dashed line.

A discharge tray 50 is provided on a top surface of the main body 2 to hold sheets 3 printed in layers. The discharge tray 50 is constructed with substantially a flat plane. There is a space, which is partially open, for inserting the process cartridge 17 at the front of the main body 2 into an accommodating portion 55 that is designed to accommodate and detachably store the process cartridge 17. The process cartridge 17 is removed from or inserted into the accommodating portion 55 of the main body 2 when a cover 54 at the front of the main body 2 is fully opened (indicated by a dotted line) by rotating about a support shaft 54*a* downward.

At the rear of the main body 2 (the left side in the figure), a conveyance guide 44 is disposed along the back of the main body 2 extending upward in a curve such as to lead a sheet 3, which is ejected from the fixing unit 18 provided on a rear side of a lower portion in the main body 2, to the discharge tray 50. Ejection rollers 45 are disposed at the end of the conveyance guide 44 with respect to a direction that the sheet 3 is fed (hereinafter referred to as a sheet feed direction). The ejection rollers 45 are designed such as to eject the sheet 3 to the discharge tray 50.

The feeder unit 4 includes a sheet feed roller 8 disposed at a bottom portion of the main body 2, a sheet cassette 6 detachably attached to the main body 2, a presser plate 7 that allows sheets 3 to be stacked thereon and pressed against the sheet feed roller 8, a conveyance guide 46 that feeds the sheets 3 supplied by the sheet feed roller 8, and resist rollers 12 and 13 provided just before the image formation part 5 at the downstream side of the sheet feed direction with respect to the sheet feed roller 8. The resist rollers 12 and 13 adjust a timing at which the sheet 3 is fed to the image formation part 5 for printing. The resist roller 12 is rotatably supported to the process cartridge 17 and the resist roller 13 is rotatably supported in the main body 2.

The presser plate 7 allows sheets 3 to be stacked thereon. The presser plate 7 is pivotally supported to the bottom surface of the sheet cassette 6 at its rear end remote from the sheet feed roller 8 such that the presser plate 7 is vertically movable at its front end closest to the sheet feed roller 8. The presser plate 7 is urged by a spring (not shown) from its reverse side toward the sheet feed roller 8. Thus, when the stack of sheets 3 increases in quantity, the presser plate 7 is swung downwardly against the urging force of the spring.

The scanner unit 16 of the image formation part 5 is disposed directly under the discharge tray 50 in the main body 2 and has a laser light source 19, a polygonal mirror 20, an fθ lens 21, a cylinder lens 22, and a reflecting mirror 23. The laser light source 19 emits a laser beam. The polygonal mirror 20 rotates and scans the laser beam emitted from the laser light source 19 in the main scanning direction. The fθ lens 21 stabilizes a scanning speed of the laser beam scanned on the polygon mirror 20. The cylinder lens 22 corrects optical face tangle error in a sub scanning direction when the laser beam is focused on a photosensitive drum 27. The reflecting mirror 23 reflects the laser beam passing through the cylinder lens 22 toward the photosensitive drum 27. In the scanner unit 16, a laser beam emitted from the laser light source 19 based on print data sequentially passes through or reflects from the polygon mirror 20, the fθ lens 21, the cylinder lens 22, and the reflecting mirror 23 in order as indicated by a dot-dashed line in FIG. 1. The scanner unit 16 thus directs the laser beam to the surface of the photosensitive drum 27 of the process cartridge 17. In the embodiment, the scanner unit 16 is an example of a light exposure device (i.e., an exposure unit), and the polygon mirror 20 and the reflecting mirror 23 are examples of a scanning device and a reflecting device respectively.

The fixing unit 18 of the image formation part 5 is disposed at a side of the process cartridge 17 downstream therefrom, and has a fixing roller 41, a pressure roller 42 that presses the fixing roller 41, and a pair of conveying rollers 43 disposed downstream from the fixing roller 41 and the pressure roller 42. The fixing roller 41 is a roller formed by firing a hollow aluminum tube coated with fluorine resin, and has a halogen lamp 41*a* for heating in the tube. The pressure roller 42 is a roller formed by covering a base material made of a low hard rubber with a fluorine resin tube. The pressure roller 42 is urged at its axis by a spring (not shown) toward the fixing roller 41 such as to press into contact with the fixing roller 42. In the fixing unit 18, toner transferred onto a sheet 3 in the process cartridge 17 melts due to the applied heat and becomes fixed on the sheet 3 while the sheet 3 passes between the fixing roller 41 and the pressure roller 42. The sheet 3 is conveyed toward the conveying rollers 43 and carried along the conveyance guide 44.

The process cartridge 17 of the image formation part 5 includes a drum cartridge 17*a* and a developing cartridge 17*b* detachably attached to the drum cartridge 17*a*. The drum cartridge 17*a* includes the photosensitive drum 27 and a scorotron charger 29. The developing cartridge 17*b* includes a developing roller 31, a supply roller 33, and a toner hopper 34.

The photosensitive drum 27 of the drum cartridge 17*a* is disposed such that it rotates in a direction of an arrow (clockwise in FIG. 1) in contact with the developing roller 31. The photosensitive drum 27 is formed by applying a positively charged organic photoconductor on a conductive base material. The photosensitive drum 27 is a positively charged organic photoconductor wherein a carriage generation material is dispersed in a carrier transport layer. When the photosensitive drum 27 is irradiated with, for example, a laser beam, charge carriers are generated in the carrier generation material due to beam absorption, the charge carriers are transported to the surface of the photosensitive drum 27 and the conductive base material in the carrier transport layer, and the potential of the surface charged by the charger 29 is cancelled. Thus, the potential difference is made between an irradiated portion and a non-irradiated portion. A laser beam is directed to the surface of the photosensitive drum 27 based on print data, and an electrostatic latent image is formed on the photosensitive drum 27. In the embodiment, the photosensitive drum 27 is an example of an image holding member (i.e., an image carrier).

The scorotron charger 29 is disposed at a side of the photosensitive drum 27 on the rear side of the main body 2 and separated therefrom by a predetermined distance so as not to contact the photosensitive drum 27. The scorotron charger 29 generates a corona discharge from a wire 29*a* made of tungsten for electric discharging, and discharging voltage is stabilized through a grid electrode 29*b*. The wire 29*a* is suspended parallel to an axial direction of the photosensitive drum 27. The wire 29*a* and the grid electrode 29*b* are enclosed with covers 29*c* and 29*d* enclosing from above and below for protection. The grid electrode 29*b* is a grid surface electrode and is disposed such that its surface is parallel to the tangent of the photosensitive drum 27. A charging bias is applied to the charger 29 during printing, and the surface of the photosensitive drum 27 is uniformly charged positively. In the embodiment, the charger 29 is an example of a charging device.

When the developing cartridge 17*b* is attached to the drum cartridge 17*a*, the developing roller 31 makes contact with the opposite side of the photosensitive drum 27 from the charger 29. This position is downstream of the charger 29 in the rotation direction of the photosensitive drum 27 (counterclockwise in FIG. 1). The developing roller 31 is supported to the developing cartridge 17*b* rotatably in the direction of the arrow (counterclockwise in FIG. 1). The developing roller 31 is formed by covering a metal roller shaft with a roller made of conductive rubber, and receives a bias for developing during printing. In the embodiment, the developing roller 31 is an example of a developing device (i.e, developing member).

The supply roller 33 is rotatably disposed at a front side of the developing roller 31 on a side opposite from the photosensitive drum 27. The supply roller 33 and the developing roller 31 are disposed facing each other and in contact with each other so that the supply roller 33 press-deforms against the developing roller 31 to an appropriate extent. The supply roller 33 is formed by covering a metal roller shaft with a roller formed of a conductive foamed material, such that toner to be supplied to the developing roller 31 is charged by friction. Thus, the supply roller 33 and the developing roller 31 are disposed such as to rotate in the same arrow direction (counterclockwise in FIG. 1).

The toner hopper 34 is provided at a side of the supply roller 33. The toner hopper 34 is formed with the case 17*b* with the hopper 34 including a top surface 37 that is a part of the case 17*b*. The toner hopper 34 also contains developing agent to be supplied to the developing roller 31 via the supply roller 33. Nonmagnetic single-component toner is used as a developing agent in the embodiment. This toner is a polymerized toner obtained through copolymerization of styrene-based monomers, such as styrene, and acryl-based monomers, such as acrylic acid, alkyl (C1–C4) acrylate, or alkyl (C1–C4) methacrylate, using a known polymerization method, such as suspension polymerization. The particle shape of such a polymerized toner is spherical, its particle size is approximately 6–10 μm and thus the polymerized toner has excellent flowability. A coloring agent, such as carbon black, and wax are added to the polymerized toner. An external additive, such as silica, is also added to the polymerized toner to improve flowability.

An agitator 36 is a roughly netted plate-like member extending in its axial direction (in a front to rear direction of the drawing), wherein a rotating shaft 35*a* is provided at an end of a supporting portion 35 that protrudes in a direction perpendicular to one surface of the agitator 36 and a film member 36a is provided at the other end of the agitator 36 such as to slide the inner wall of the toner hopper 34. When the agitator 36, in which the rotating shaft 35*a* is supported at a central portion on each end in a longitudinal direction of the toner hopper 34, rotates in a direction of an arrow (clockwise in the figure), toner contained in the toner hopper 34 is agitated.

A transfer roller 30 is disposed downstream from the developing roller 31 with respect to the rotation direction of the photosensitive drum 27 and in a lower portion of the photosensitive drum 27, and supported rotatably in a direction of an arrow (clockwise in the figure) in the main body 2. The transfer roller 30 is formed by covering a metal roller shaft with a roller formed of an ion-conductive rubber material, such as to receive a transfer bias during printing. The transfer bias is a bias applied to the transfer roller 30 such as to generate a potential difference in a direction where toner, which is electrostatically adhered on the surface of the photosensitive drum 27, is electrically attracted to the surface of the transfer roller 30. In the embodiment, the transfer roller 30 is an example of a transferring device (i.e., a transfer member).

Conveyance guides 47 and 48 are disposed such that their surfaces are substantially parallel to the arrangement of the charger 29, the photosensitive drum 27, and the developing roller 31. The conveyance guide 47 is designed to lead the sheets 3 fed from the resist rollers 12, 13 toward a nip portion between the photosensitive drum 27 and the transfer roller 30. The conveyance guide 48 is designed to lead the sheets 3 that pass through the nip portion between the photosensitive drum 27 and the transfer roller 30 toward a nip portion between the fixing roller 41 and the pressure roller 42 in the fixing unit 18. The conveyance guides 47, 48 each include a plurality of rib-shaped protrusions 47*a*, 48*a* that extend in the sheet feed direction on the top surfaces. A sheet conveying path by the conveyance guides 47, 48 is an example of a sheet conveying path.

The conveyance guide 48 faces the charger 29, and an insulation member 53 is affixed to a lower cover 29*d* of the charger 29 on a side facing the conveyance guide 48. As the charger 29, the photosensitive drum 27, and the developing roller 31 are arranged substantially in a line, the charger 29 is brought close to the conveyance guide 48. A high voltage (several thousand voltages) is applied to the wire 29*a* of the charger 29 during printing. (At this time, the grid electrode 29*b* is adjusted to a potential of approximately 1000V.) The insulation member 53 is provided such as to avoid a detrimental electrical effect on the sheet 3 fed on the conveyance guide 48 caused by the potential difference (for example, curling up of the sheet 3 while being fed).

As the charger 29 and the developing roller 31 are disposed on front and rear sides of the photosensitive drum 27, the photosensitive drum 27 is widely open at an upper portion. A protective member 49 is provided on the top of a housing of the drum cartridge 17*a* to cover the open area. The protective member 49 is a plate-like member that conceals the open area of the upper portion of the photosensitive drum 27, and is provided with an opening 49*a* formed therein such as not to block the light path (indicated by the dot dashed line in FIG. 1) of a laser beam emitted from the scanner unit 16 fixed to the main body 2 when the process cartridge 17 is attached to the main body 2. When the process cartridge 17 is removed from the accommodating portion 55 of the main body 2, the protective member 49 protects the photosensitive drum 27 from being touched by a user accidentally or exposed to light except for the time of printing.

In the laser printer 1, a cleaner-less developing method is adopted, wherein toner, which remains on the surface of the photosensitive drum 27 after it is transferred from the photosensitive drum 27 to the sheet 3 by the transfer roller 30, is collected by the developing roller 31. Namely, in the cleaner-less developing method, toner remains on the surface of the photosensitive drum 27 after the photosensitive drum 27 is charged by the charger 29 and the photosensitive drum 27 is exposed to light by the scanner unit 16. Toner remaining in an unexposed portion is electrically collected by the developing roller 31 when the surface of the photosensitive drum 27 faces the developing roller 31. On the other hand, in the exposed portion, a toner image is formed by toner remaining after toner is supplied from the developing roller 31.

According to such a cleaner-less developing method, a storage place for collecting and storing the remaining toner after transferring is unnecessary. Thus, simplification of the apparatus structure and elimination of a space for such a storage place can be achieved, thereby making the process cartridge 17 thin. If the storage place is integrally formed with the drum cartridge 17*a*, the useful life of the drum cartridge 17*a* is determined by the capacity of the storage place, increasing the useful life of the drum cartridge 17*a* and making the apparatus thin can not be achieved. However, the cleaner-less developing method enables both of the above.

In the embodiment of the invention, the developing roller 31 rotates1.6 times as fast as the photosensitive drum 27.

With a speed difference, the toner remaining after transferring is likely to be collected from the photosensitive drum 27 to the developing roller 31.

The toner used in the laser printer 1 is a polymerized toner of which particle shape is substantially spherical thus having excellent flowability. Thereby images can be formed excellently, and the remaining toner after transferring can be efficiently collected through the use of the cleaner-less development method.

Referring to FIG. 1, operations of the laser printer 1 during printing will be described. In the laser printer 1, a drive motor (not shown) is driven based on a reception of print data from a host computer (not shown). As shown in FIG. 1, a sheet 3 is picked up by friction produced by the sheet feed roller 8 that rotates, and is fed to the resist rollers 12, 13. The resist rollers 12, 13 resists and feeds the sheets 3 while a front edge of a visible image formed on the surface of the photosensitive drum 27 is aligned with a leading edge of the sheet 3.

In the scanner unit 16, on the other hand, a laser beam is generated at the laser light source 19 in accordance with a laser drive signal generated based on the print data, and emitted to the polygon mirror 20. The polygon mirror 20 scans the incident laser beam in the main scanning direction (which is perpendicular to the sheet feed direction), and directs it to the fθ lens 21. The fθ lens 21 converts the laser beam scanned at a constant angular velocity into a laser beam scanned at a uniform velocity. The laser beam is converged at the cylindrical lens 22, is reflected at the reflecting mirror 23, and directed to the surface of the photosensitive drum 27 to form an image thereon.

Figure 2:
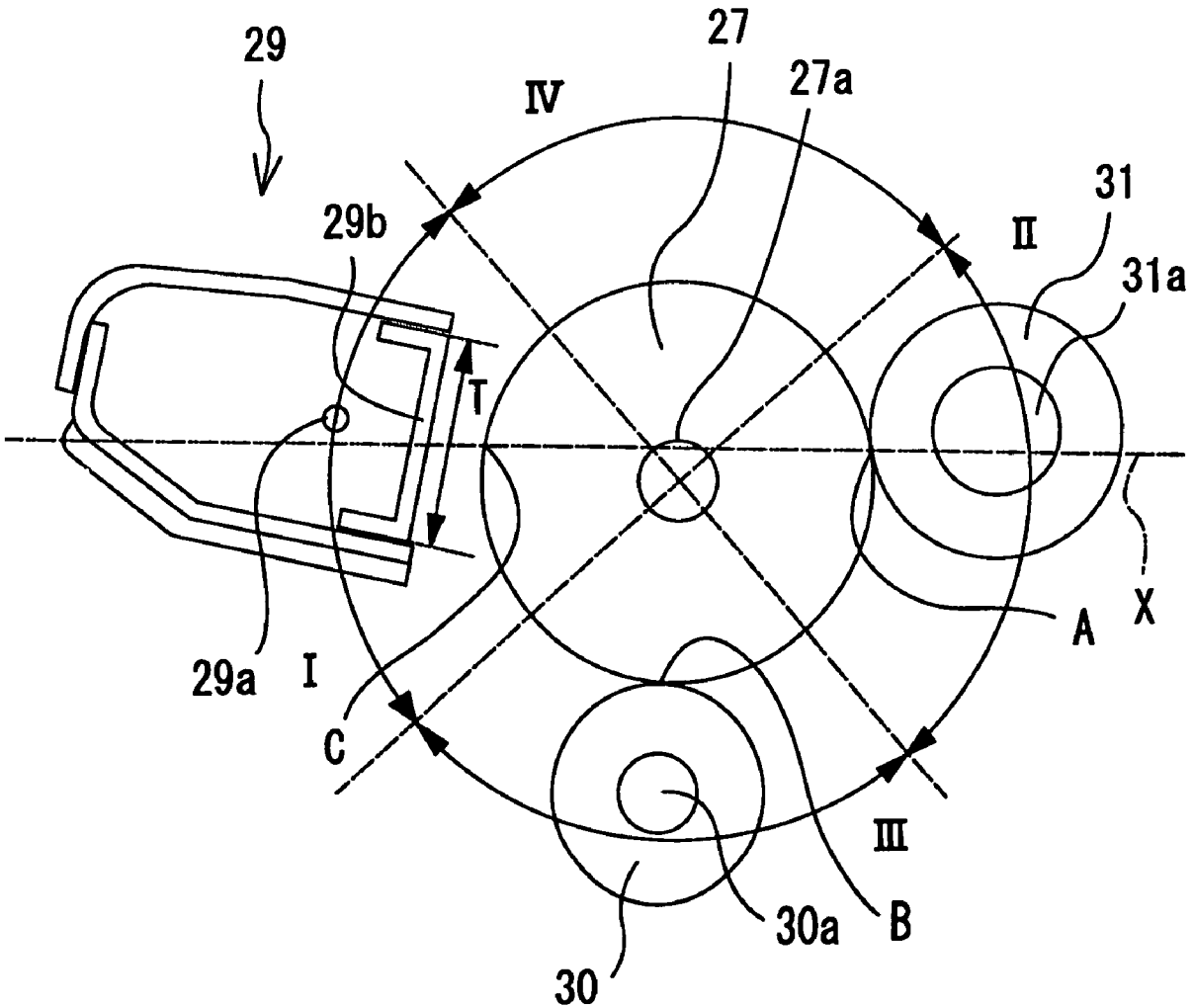
FIG. 2 shows a relationship of a photosensitive drum and parts disposed around the photosensitive drum.

The photosensitive drum 27 is charged by the charger 29 to which a charging bias is applied by a high-voltage power supply (not shown), such that the surface potential becomes approximately 1000V. The photosensitive drum 27 rotating clockwise in FIG. 2 is irradiated with the laser beam. The laser beam is emitted from the scanner unit 16 in the main scanning direction such that it is incident to a portion to form an image and it is not incident to a portion to form no image. In the portion irradiated with the laser beam (an exposed portion), the surface potential drops to 200V for example. With a rotation of the photosensitive drum 27, the laser beam is also emitted in the sub scanning direction (the sheet feed direction), an image invisible electrically, that is a latent image, is formed on the surface of the photosensitive drum 27 between the exposed portion and the portion not irradiated with the laser beam (an unexposed portion).

Toner, which is supplied from the toner hopper 34 and positively charged between the supply roller 33 and the developing roller 31 by friction, is adjusted to a thin layer of a predetermined thickness, and carried on the developing roller 31. A positive developing bias of approximately 400V is applied to the developing roller 31 from the high-voltage power supply (not shown). By rotating the developing roller 31, toner carried on the developing roller 31 and positively charged is brought in contact with the photosensitive drum 27, and is transferred to an electrostatic latent image formed on the surface of the photosensitive drum 27. That is, the potential of the developing roller 31 is lower than the potential of the unexposed portion (+1000V) and higher than the potential of the exposed portion (+200V), so that toner is selectively transferred to the exposed portion where the potential is low. Thus, a visible image is formed on the surface of the photosensitive drum 27 as a developing agent image by toner.

When the sheet 3 is passing between the photosensitive drum 27 and the transfer roller 30, a transfer bias or a negative constant current of approximately −1000V, which is still lower than the potential of the exposed portion (+200V), is applied to the transfer roller 30, and the visible image formed on the surface of the photosensitive drum 27 is transferred to the sheet 3.

The sheet 3 to which toner has been transferred is fed toward the fixing unit 18. The fixing unit 18 applies a heat of approximately 200° C. by the fixing roller 41 and a pressure by the pressure roller 42 to the sheet 3, so that toner melts on the sheet 3 to form an external image. The fixing roller 41 and the pressure roller 42 are grounded via respective diodes, and set such that the surface potential of the pressure roller 42 is lower than the surface potential of the fixing roller 41. Thus, positively charged toner placed on the sheet 3 on the side facing the fixing roller 41 is electrically attracted to the pressure roller 42 by the pressure roller 42 via the sheet 3. Thereby preventing distortion of the image that may occur when toner is attracted to the fixing roller 41 during fixing.

The sheet 3 on which toner was melted and fixed through the fixing unit 18 is conveyed along the conveyance guide 44, and ejected to the discharge paper tray 50 by the ejection rollers 45 with a printed face facing downward. Similarly, the following sheet 3 to be printed is stacked on the discharge paper tray 50 with a printed face facing downward. Thus, the user can obtain the printed sheets 3 arranged in the order printed.

As described above, in the laser printer 1 of the embodiment, the charger 29, the developing roller 31, and the transfer roller 30 are disposed such as to face the surface of the photosensitive drum 27. In addition, the surface of the photosensitive drum 27 includes some parts irradiated with a laser beam. The layout of these parts around the photosensitive drum 27 is determined based on conditions shown in FIG. 2 in order to shrink the size of the laser printer 1. FIG. 2 shows a relationship of a photosensitive drum 27 and parts disposed around the photosensitive drum 27.

As shown in FIG. 2, the photosensitive drum 27 is divided into four equal sections (i.e., sections I–IV) as to a cross section of the photosensitive drum 27, which is perpendicular to a shaft thereof, at an outer surface of the photosensitive drum 27. As shown in FIG. 2, an up and down direction is regarded as a top and bottom of the laser printer 1, and a left and right direction is regarded as a rear and front direction of the laser printer 1. As such, the left most section and the right most section is referred to as section I and section II, respectively. The bottom most section and the top most section is referred to as section III and section IV, respectively. As should be appreciated, section I is opposite to section II, and section III is opposite to section IV. In the embodiment, a process device is a member that operates with respect to the photosensitive drum 27 to perform image formation. For example, the process device is the developing roller 31, the transfer roller 30, the charger 29, and a cleaning member to clean the photosensitive drum 27 (for example, a cleaning blade, a cleaning brush, and a cleaning roller). The sections I, II, III, IV function as a first range, a second range, a third range, and a fourth range, respectively.

The section I is for an area that the charger 29 acts. The charger 29 is structured such that the grid electrode **29*b* stabilizes a discharge voltage from the wire 29*a* as described above, and the acting area is a range T where the surface of the grid electrode 29*b* faces the surface of the photosensitive drum 27. A center on the surface of the photosensitive drum 27 in the range T with respect to the rotation direction thereof is a center of action C of the charger 29. At this time, the surface of the grid electrode 29*b* is parallel to a tangent line of the surface of the photosensitive drum 27. Charging the surface of the photosensitive drum 27 by the charger 29 is performed in the entire range T. Thus, a point on the surface of the photosensitive drum 27, through which a straight line connecting the wire 29***a* and the shaft 27*a* passes, is regarded as the center of action C of the charger 29 with respect to the photosensitive drum 27. The center of action C is present at least in the section I.

The section II is for an area that the developing roller 31 acts, and where an electrostatic latent image on the photosensitive drum 27 is developed using toner carried on the developing roller 31. A center of a nip portion between the developing roller 31 and the photosensitive drum 27 with respect to the rotation direction of the photosensitive drum 27 is a center of action A. Regardless of whether the photosensitive drum 27 and the developing roller 31 make contact with each other, the center of action A is a point on the surface of the photosensitive drum 27, through which a straight line connecting a shaft 27*a* of the photosensitive drum 27 and a shaft 31*a* of the developing roller 31 passes, and the center of action A is present at least in the section II.

Similarly, the section III is for an area that the transfer roller 30 acts, where a nip portion between the photosensitive drum 27 and the transfer roller 30 is disposed. A point on the surface of the photosensitive drum 27, through which a line connecting the shaft 27*a* and a shaft 30*a* of the transfer roller 30 passes, is a center of action B of the transfer roller 30, and the center of action B is present at least in the section m.

Thus, in the section IV, none of the developing roller 31, the transfer roller 30, and the charger 29, which function as a process device, is disposed. However, a laser beam emitted from the scanner unit 16 (FIG. 1) disposed above the photosensitive drum 27 is incident in the section IV. In other words, as the laser beam from the scanner unit 16 may be incident anywhere within the section IV, a high degree of flexibility in a position where a laser beam is emitted from the scanner unit 16 may be provided.

Thus, various operating areas are provided for the corresponding parts, and especially with respect to the photosensitive drum 27, the area that the charger 29 acts and the area that the developing roller 31 are disposed in the sections I and II respectively opposing each other. Thus, as shown in FIG. 1, the charger 29, the photosensitive drum 27, and the developing roller 31 are disposed substantially in a line X. Accordingly, the charger 29 and the photosensitive drum 27, which constitute the drum cartridge 17*a*, are disposed substantially horizontally with respect to the laser printer 1, and the drum cartridge 17*a* can be made thin.

Thereby, the photosensitive drum 27 and the scanner unit 16 can be disposed close to each other in the main body 2. In addition, as the degree of flexibility in the exit position of the laser beam from the scanner unit 16 is high, it is sufficiently possible to place the laser beam emitted from the scanner unit 16 within the section IV even when the photosensitive drum 27 and the scanner unit 16 are disposed close to each other. Further, as the degree of flexibility in the exit position of the laser beam from the scanner unit 16 is high, a degree of flexibility in arranging the parts making up the scanner unit 16 also becomes high, thereby obtaining a light path of a laser beam sufficiently without having to fold the light path multiple times. In the laser printer 1, the light path from the laser light source 19 to the reflecting mirror 23 in the scanner unit 16 is placed substantially within a plane and a laser beam is emitted from the scanner unit 16 by changing its angle via reflection by the reflecting mirror 23. Accordingly, the changing of a direction of light is conducted only one time, and the scanner unit 16 can be made thin. The discharge paper tray 50 is constructed with substantially a flat plane, the flat plane of the discharge paper tray 50, and the top surface of the scanner unit 16, which is disposed directly under the discharge paper tray 50, and the plane forming the light path of a laser beam are substantially parallel to each other, thereby omitting a waste space in the main body 2.

The process cartridge 17 is attached and removed along the line X that connects the center of action C of the charger 29 and the center of action A of the developing roller 31. A bottom surface of a casing of the scanner unit 16 is substantially parallel to the direction X such as not to interfere with the attachment and removal of the process cartridge 17. The top surface 37 of the toner hopper 34 of the developing cartridge 17*b* is provided in parallel along the bottom surface of the casing of the scanner unit 16 and in parallel with the line X. Thus, the process cartridge 17 can be attached and removed from the accommodating portion 55 of the main body 2 in a direction that is parallel to the straight line X, and a space required for attaching and removing the process cartridge 17 to the accommodating portion 55 in the main body 2 can be omitted. Further, the space for storing the process cartridge 17, except where the essential parts of the process device are placed, can be maximally utilized as the toner hopper 34. As such, the amount of toner to be contained can be increased even when a space in the main body 2 becomes small.

The conveyance guides 47, 48 are disposed such that their planes are substantially parallel to the line X that connects the center of action C of the charger 29 and the center of action A of the developing roller 31. Namely, a direction where a sheet 3 is fed on the conveyance guides 47, 48 is substantially parallel to the direction where the process cartridge 17 is removed or attached, the bottom surface of the scanner unit 16, and the surface of the discharge paper tray 50, so that space in the main body 2 can be utilized effectively.

As the laser printer 1 is structured above, the thickness of the main body 2 can be decreased, and thus the laser printer 1 can be made thin. With this reason, even if a multifunction apparatus where an image reading apparatus is disposed on an upper portion of the laser printer 1 is designed, for example, the size of the entire apparatus can be made compact.

As described above, the laser printer 1 of the embodiment is structured wherein the charger 29, the photosensitive drum 27, and the developing roller 31 are arranged substantially along the line X. As none of the process device, that is, the charger 29, the transfer roller 30 and the developing roller 31 is disposed above the photosensitive drum 27, the scanner unit 16 can be disposed close to the photosensitive drum 27. Further, as there is not any part that operates close to the upper area on the surface of the photosensitive drum 27, a wide range for irradiation with a laser beam emitted from the scanner unit 16 can be obtained, the degree of flexibility in arrangement of parts making up the scanner unit 16 can be increased, and the scanner unit 16 can be made thin.

As the charger 29, the photosensitive drum 27, and the developing roller 31 are arranged substantially along the line X, the process cartridge 17 can be designed thin. The top surface of the process cartridge 17 is provided substantially parallel to the bottom of the housing of the scanner unit 16, such that the scanner unit 16 does not interfere with the removal and attachment of the process cartridge 17. With this structure, the main body 2 can be made thin while the process cartridge 17 can be removed and attached.

In addition, as the insulation member 53 is provided on the wall surface of the cover 29*d* on the side facing the conveyance guide 48, there is no electrical effect to a sheet 3 to be fed on the conveyance guide 48 by the charger 29 that is disposed close to the conveyance guide 48. As the protective member 49 is provided to cover the upper portion of the photosensitive drum 27, the user will not touch the surface of the photosensitive drum 27 accidentally when removing or attaching the process cartridge 17. Further, the protective member 49 prevents the exposure of the surface of the photosensitive drum 27 to light at all times except when printing.

While the invention has been described in conjunction with specific embodiments thereof, it is evident that many alternative, modifications and variations may be apparent to those skilled in the art. Accordingly, the preferred embodiments of the invention as set forth herein are intended to be illustrative, not limiting. Various changes may be made without departing from the spirit and scope of the invention as defined in the following claims. For example, the transfer roller 30 may be stored in the drum cartridge 17*a* to be integrally formed with the photosensitive drum 27 and the charger 29. The charger 29 may be provided with more than one wire 29*a*. The direction where the process cartridge 17 is removed or attached may be a sideways direction of the laser printer 1 as long as the process cartridge 17 can be removed or attached along the wall surface of the housing of the scanner unit 16.

What is claimed is:

1. A process cartridge, comprising:

a case;

an image carrier rotatably provided at the case, a surface of the image carrier being divided into four sections by two perpendicular lines that are perpendicular to a center of the image carrier;

a charger that is disposed on the case along the surface of the image carrier and that uniformly charges the surface of the image carrier, wherein only a single charger is used in the process cartridge;

a developing member that is disposed on the case along the surface of the image carrier and that supplies a developing agent to the image carrier, wherein the charger is located at a first section of the four sections and the developing member is located at a second section of the four sections that is opposite to the first section; and a hopper that stores the developing agent supplied to the developing member, wherein a height of the image carrier is less than or equal to a height of the hopper.

2. The process cartridge according to claim 1, further comprising:

a transfer member that is disposed on the case along the surface of the image carrier and that transfers the developing agent from the surface of the image carrier to a recording medium, wherein the transfer member is located at a third section of the four section that is between the first section and the second section.

3. The process cartridge according to claim 2, wherein the case includes an opening disposed at a fourth section of the four sections that is opposite to the third section.

4. The process cartridge according to claim 2, wherein the charger is located closer to the transfer member than the developing member.

5. The process cartridge according to claim 1, wherein the charger, the image carrier and the developing member are located along a straight line.

6. An image forming apparatus, comprising:

an image carrier rotatably provided at the image forming apparatus, a surface of the image carrier being divided into four sections by two perpendicular lines that are perpendicular to a center of the image carrier;

a charger that is disposed along the surface of the image carrier and that uniformly charges the surface of the image carrier, wherein only a single charger is used in the image forming apparatus; and a developing member that is disposed along the surface of the image carrier and that supplies a developing agent to the image carrier, wherein (1) the charger is located at a first section of the four sections and the developing member is located at a second section of the four sections that is opposite to the first section, and (2) the charger is not disposed above the image carrier.

7. The image forming apparatus according to claim 6, further comprising:

a transfer member that is disposed along the surface of the image carrier and that transfers the developing agent from the surface of the image carrier to a recording medium, wherein the transfer member is located at a third section of the four sections that is between the first section and the second section.

8. The image forming apparatus according to claim 7, further comprising:

an exposure unit that is disposed along the surface of the image carrier and that emits a light beam onto the surface of the image carrier, wherein the exposure unit is located at a fourth section of the four sections that is opposite to the third section.

9. The image forming apparatus according to claim 7, wherein the charger is located closer to the transfer member than the developing member.

10. The image forming apparatus according to claim 6, wherein the charger, the image carrier and the developing member are located along a straight line.

11. he image forming apparatus according to claim 10, wherein the image carrier, the charger and the developing member are provided at a case of a process cartridge.

12. The image forming apparatus according to claim 11, further comprising:

an accommodating portion that accommodates the process cartridge, wherein the process cartridge is attached to and removed from the accommodating portion in a direction that is parallel to the straight line.

13. The image forming apparatus according to claim 11, further comprising:

an exposure unit that is disposed along the surface of the image carrier and that emits a light beam onto the surface of the image carrier, wherein the exposure unit is located above the process cartridge.

14. The image forming apparatus according to claim 13, wherein the exposure unit comprises:

a light source that emits the light beam;

a scanning element that scans the light beam to travel along a light path; and a single reflecting unit that reflects the light beam toward the image carrier.

15. The image forming apparatus according to claim 14, wherein the light path is placed substantially within a plane parallel to the straight line.

16. The image forming apparatus according to claim 13, wherein the case includes an opening disposed at a fourth section of the four sections and the light beam emitted by the exposure unit passes through the opening.

17. The image forming apparatus according to claim 10, further comprising:

a supply device that supplies the recording medium to the image carrier, the developing agent being transferred to the recording medium from the image carrier; and a discharge device that discharges the recording medium on which the developing agent is transferred to a discharge tray, wherein the discharge tray is disposed to be parallel to the straight line.

18. The image forming apparatus according to claim 17, wherein the supply device feeds the recording medium along a feed path, the feed path being parallel to the straight line.

19. The image forming apparatus according to claim 11, wherein the process cartridge comprises:

a hopper that is formed with the case, the hopper storing the developing agent therein, wherein the hopper includes a top surface which is part of the case, the top surface being parallel to the straight line.

20. The image forming apparatus according to claim 7, wherein the image carrier, the charger, the developing member and the transfer member are provided at a case of a process cartridge.

21. The image forming apparatus according to claim 20, wherein the charger is located closer to the transfer member than the developing member.

22. The image forming apparatus according to claim 21, wherein the charger, the image carrier and the developing member are located along a straight line.

23. The image forming apparatus according to claim 22, further comprising:

an accommodating portion that accommodates the process cartridge, wherein the process cartridge is attached to and removed from the accommodating portion in a direction that is parallel to the straight line.

24. A process cartridge, comprising:

a photosensitive drum that rotates relative to a photosensitive drum shaft;

a charger that is disposed along a surface of the photosensitive drum and that uniformly charges the surface of the photosensitive drum, wherein only a single charger is used in the process cartridge;

a developing roller that rotates relative to a developing roller shaft, that is disposed along the surface of the photosensitive drum and that supplies toner to the photosensitive drum, wherein the charger is located along a straight line that connects the photosensitive drum shaft and the developing roller shaft; and a hopper that stores the developing agent supplied to the developing roller. wherein a height of the photosensitive drum is less than or equal to a height of the hopper.

25. The process cartridge according to claim 24, further comprising:

a transfer roller that is disposed along the surface of the photosensitive drum between the charger and the developing roller and that transfers the toner to a recording medium.

26. The process cartridge according to claim 25, wherein the charger is located closer to the transfer roller than the developing roller.

27. The process cartridge according to claim 25, wherein the surface of the photosensitive drum is divided into four sections by two perpendicular lines that are perpendicular to the photosensitive drum shaft, the charger being located at a first section of the four sections, the developing roller being located at a second section of the four sections that is opposite to the first section and the transfer roller being located at a third section of the four sections between the first section and the second section.

28. The process cartridge according to claim 27, further comprising:

a case that supports the photosensitive drum, the charger, the developing roller and the transfer roller, the case having an opening at a fourth section of the four sections that is opposite to the third section.

29. The process cartridge according to claim 1, wherein the charger is a scorotron charger.

30. The image forming apparatus according to claim 6, wherein the charger is a scorotron charger.

31. The process cartridge according to claim 24, wherein the charger is a scorotron charger.

* * * * *